US006666720B1

(12) United States Patent
Reisinger et al.

(10) Patent No.: US 6,666,720 B1
(45) Date of Patent: Dec. 23, 2003

(54) ELECTRICAL CONNECTOR RECEPTACLE WITH MODULE KICKOUT MECHANISM

(75) Inventors: Jason M'Cheyne Reisinger, Carlisle, PA (US); Michael Eugene Shirk, Grantville, PA (US); James Charles Shiffler, Hummelstown, PA (US); Thomas Edward Lowe, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/209,790

(22) Filed: Jul. 31, 2002

(51) Int. Cl.[7] ..... H01R 13/648
(52) U.S. Cl. ..... 439/607
(58) Field of Search ..... 439/607–610, 439/352, 357, 696

(56) References Cited

U.S. PATENT DOCUMENTS

| | | | | |
|---|---|---|---|---|
| 4,847,588 A | | 7/1989 | Doutrich | |
| 6,364,709 B1 | | 4/2002 | Jones | |
| 6,368,153 B1 | | 4/2002 | Hwang | |
| 6,416,361 B1 | | 7/2002 | Hwang | |
| 6,419,523 B1 | | 7/2002 | Jones et al. | |
| 6,443,768 B1 | * | 9/2002 | Dirkers et al. | 439/607 |
| 6,517,382 B2 | * | 2/2003 | Flickinger et al. | 439/607 |
| 6,524,134 B2 | * | 2/2003 | Flickinger et al. | 439/607 |

OTHER PUBLICATIONS

"Small Form Factor Pluggable Solder–Down Cage", PicoLight, Rev 5, Apr. 2002, p. 1–5.
"Small Form Factor Pluggable Press–Fit Cage", PicoLight, Rev 12, Apr. 2002, p. 1–10.
"Small Form–Factor Pluggable (SFP) Transceiver Multi-Source Agreement (MSA)", Sep. 14, 2000, p. 1–38.
"SPT–RS020B–12", Drawing No. K–510500 (Rev B), drawn by K. Ozai, Jun. 16, 2000, p. 1–3.
"SFP System", Tyco Electronics AMP, Apr. 2000, p. 1–2.
"SFP Cage Assembly 15 Press–Fit Legs and 3 EMI Clips", Molex Incorporated, (Rev B1), Aug. 1, 2000, p. 1–6.
"SFP Cage Assembly 11 Press–Fit Legs and 3 EMI Clips", Molex Incorporated, (Rev B1), Aug. 1, 2000, p. 1–7.

* cited by examiner

*Primary Examiner*—Lynn Feild
*Assistant Examiner*—Son V. Nguyen

(57) ABSTRACT

An electrical connector receptacle cage is provided including upper and lower shells. The upper and lower shells are joined to one another to define a module retention chamber with an open front end configured to accept a module. At least one of the shells has a rear wall closing the back end of the module retention chamber, and side walls extending between the front and back ends. The upper shell comprises a top wall extending between the front and back ends including a flexible section formed proximate the back end. A kickout spring is joined to the flexible section, and has a module engaging section extending into the module retention chamber toward the front end which is configured to contact and exert an ejection force on the module when the module is inserted into the module retention chamber.

26 Claims, 8 Drawing Sheets

ELECTRICAL CONNECTOR RECEPTACLE WITH MODULE KICKOUT MECHANISM

RELATED APPLICATIONS

This application is related to Application Ser No. 10/208,921, filed on the same date as the present application, titled "Electrical Connector Receptacle Cage With Interlocking Upper and Lower Shells", the complete subject matter of which is incorporated herein by reference in its entirety.

BACKGROUND OF THE INVENTION

Certain embodiments of the present invention generally relate to electrical cable assemblies for use with high speed serial data, and more particularly, to electrical connector receptacles for connecting to a circuit board and receiving a plug or small form-factor pluggable module.

In the past, electrical connector receptacles have been proposed for receiving a plug or module which then connects to a circuit board. Conventional connector receptacles have been comprised of one or two pieces. For two piece receptacles, the bottom piece is soldered to the circuit board using multiple solder pins. The top piece is then mounted on and may also be soldered to the bottom piece. The top and bottom pieces define an internal space into which the module is inserted. The module is held in place by a mechanical locking mechanism, such as a protrusion from the module, projecting into a hole in the bottom piece.

In order to remove the module from the receptacle, an ejection button on the module is pushed in towards the back of the receptacle to disengage the locking mechanism. Conventional receptacles contain "kickout" springs typically located at the rear of the receptacle which apply a force against the module. When the locking mechanism is disengaged, the force induced on the module by the kickout spring is intended to assist in the removal of the module from the receptacle. For example, in the past, short, narrow kickout springs have been formed integral with the sides of the receptacle and bent to project towards the opening in the front of the receptacle. Alternatively, the kickout springs have been formed integral with the sides and bent into the interior of the receptacle in an "S" shape, wherein one curve of the S engages the module and one curve engages the back wall of the receptacle. The aforementioned kickout springs are typically aligned horizontally, or parallel to the floor of the receptacle and provide a double spring action as one spring is formed integral with each side.

However, conventional kickout spring designs often are unable to provide a sufficient force to overcome the friction and mating force of the ground contacts electrically engaging the module and receptacle. Additionally, some conventional kickout spring designs have a very short working range, thereby further limiting the effectiveness of the kickout springs. As a result, the user must push in, and hold, the ejection button on the module while simultaneously pulling the module out of the receptacle. The effort to hold in the ejection button and simultaneously pull on the module is awkward and time consuming, and may require a user to use both hands and/or two separate tools to remove the module.

A need exists for an electrical connector receptacle that improves the kickout effectiveness of the receptacle without sacrificing electrical performance or the latching abilities of the receptacle. Certain embodiments of the present invention are intended to meet these needs and other objectives that will become apparent from the description and drawings set forth below.

BRIEF SUMMARY OF THE INVENTION

In accordance with at least one embodiment, a small form factor pluggable (SFP) cage is provided including upper and lower shells. At least one of the upper and lower shells includes pins configured to be press fit onto a circuit board. The upper and lower shells are joined to one another to define a module retention chamber with an open front end configured to accept an SFP module. At least one of the shells has a rear wall closing the back end of the module retention chamber, and side walls extending between the front and back ends. The upper shell has a top wall extending between the front and back ends which has a flexible section formed proximate the back end. A kickout spring is joined to the flexible section of the top wall and has a module engaging section extending into the module retention chamber toward the front end. The kickout spring and flexible section are configured to contact and exert an ejection force on the SFP module when the module is inserted into the module retention chamber.

In an alternative embodiment, an electrical connector receptacle cage is provided including upper and lower shells joined together to form a plug retention chamber configured to accept an electrical plug through an open front end. At least one of the upper and lower shells has a rear wall closing the back end and having side walls extending between the front and back ends. The upper shell includes a top wall with a flexible section formed proximate the back end. The flexible section of the top wall is physically separated from the side and rear walls. A kickout spring is joined to the flexible section of the top wall. The kickout spring has a plug engaging section extending into the plug retention chamber toward the front end. The plug engaging section contacts and exerts an ejection force onto the plug when inserted into the plug retention chamber.

Figure 1:
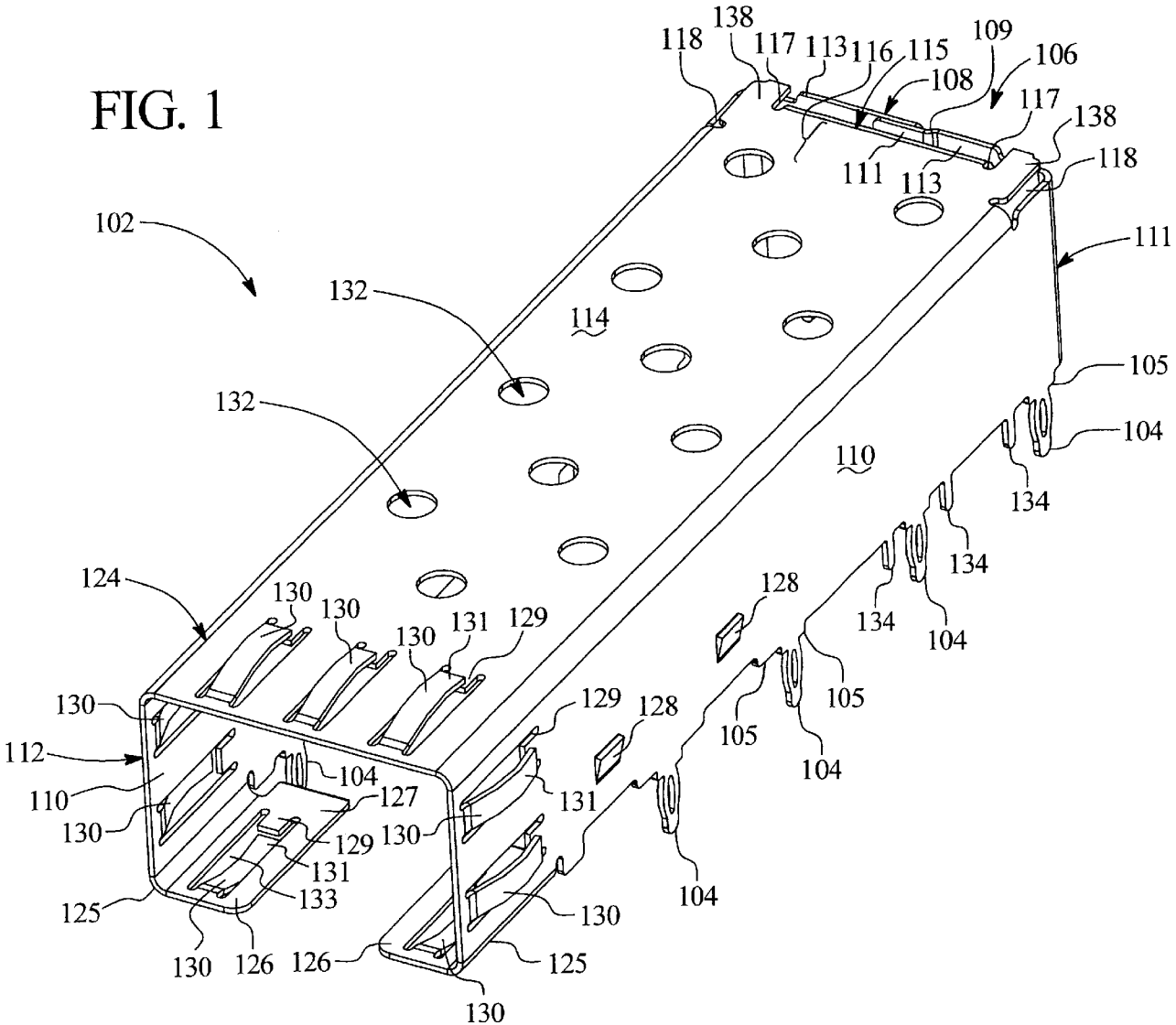
FIG. 1 illustrates an upper shell of a small form-factor (SFP) cage formed of a single piece of sheet material formed in accordance with an embodiment of the present invention.

The foregoing summary, as well as the following detailed description of certain embodiments of the present invention, will be better understood when read in conjunction with the appended drawings. For the purpose of illustrating the preferred embodiments of the present invention, there is shown in the drawings embodiments which are presently preferred. It should be understood, however, that the present invention is not limited to the arrangements and instrumentality shown in the attached drawings.

DETAILED DESCRIPTION OF THE INVENTION

FIG. 1 illustrates an upper shell 102 of a small form-factor (SFP) cage 100. The upper shell 102 is formed of a single piece of sheet material. The upper shell 102 includes a top wall 114 and two side walls 110. The sheet material is bent along edges 124 between the top wall 114 and the side walls 110. Base portions 126 are bent inward toward one another and up toward the top wall 114, and may be parallel to the top wall 114. The base portions 126 are formed on the bottom edge 125 of the side walls 110 proximate an open front end 112 formed by the front edges of the top wall 114, side walls 110 and base portions 126.

Press fit pins 104 are stamped and formed integral along the bottom edge 125 of the side walls 110. The press fit pins 104 occupy substantially the same plane as the side walls. The press fit pins 104 are formed with an elongated, or oblong shaped, body with an elongated hole in the interior portion, and further comprise shoulders 105 integral with bottom edge 125 which extend out from each side of the press fit pins 104. The press fit pins 104 are snappingly received by, and securely fasten the SFP cage 100 to, a circuit board (not shown). The shoulders 105 rest on the surface of the circuit board, acting as a standoff between the SFP cage 100 and the circuit board.

Electromagnetic interference (EMI) pins 134 are stamped and formed integral along the bottom edge 125 of the side walls 110. The EMI pins 134 may be shorter in length than the press fit pins 104 and are substantially rectangular in shape with a rounded tip. The EMI pins 134 are inserted through holes in the circuit board to penetrate the electrical plane of the circuit board. The EMI pins 134 may or may not contact the circuit board, or may be electrically connected to the circuit board. Alternatively, EMI pins 135 (FIG. 4) may be formed as press fit pins, providing improved mechanical connection between the SFP cage 100 and the circuit board. The EMI pins 135 of FIG. 4 may be narrower in width and the same length as the press fit pins 104. The EMI pins 135 of FIG. 4 may also be wider and longer than the EMI pins 134 illustrated in FIG. 1. Alternatively, press fit pins 104 and/or EMI pins 134, 135 may be formed as solder pins and soldered to the circuit board to form the mechanical and electrical connection therewith. By forming the press fit pins 104 and EMI pins 134, 135 integral with and substantially parallel to the side walls 110 of the upper shell 102, the force applied to the upper shell 102 when mounting the SFP cage 100 on the circuit board does not cause the upper shell 102 or lower shell 148 to deflect, nor deform in shape.

Ground members 130 are stamped and formed proximate the open front end 112 on the front region of the top wall 114, the side walls 110, and the base portions 126. The ground members 130 are biased outward from the top wall 114, side walls 110, and base portions 126 to engage a chassis, bezel, or other grounding structure through which the SFP cage 100 may be inserted. By bending the ground members 130 outward, open windows 133 and tabs 129 are formed in the upper shell 102. The base portions 126 further include a rear portion 127. When the ground members 130 on the base portions 126 are deflected upward by the chassis, the lead edge 131 of the ground member 130 may engage the tab 129. Similarly, tabs 129 on the top wall 114 and side walls 110 may engage corresponding ground members 130 when the SFP cage 100 is mounted in the chassis.

Ventilation holes 132 are stamped out of the top wall 114. Latching features 128 are stamped in side walls 110. The latching features 128 project outward to form a slightly ramped surface with a lance at the top edge. The rear end 115 of the top wall 114 has a pair of inner notches 117 and a pair of outer notches 118 cut therein to define a pair of tabs 138. The tabs 138 may be used to attach the upper shell 102 to a carrier strip during manufacture. The tabs 138 extend toward the rear end 106 of the upper shell 102. Inner notches 117 and outer notches 118 may be parallel to one another. The outer notches 118 define therebetween a flexible portion 116 that cooperates with a kickout spring 136 (FIG. 2) to eject a module.

The back ends 113 of the side walls 110 are bent in towards one another to close the rear end 106 of the upper shell 102. The back ends 113 overlap and form a rear wall 108, enclosing rear end 106. The rear wall 108 is perpendicular to the side walls 110. A portion of a back end 113 is bent inward toward the front end 112 and again away from the front end 112 to form a ridge 109 and an inner portion 111 of the rear wall 108. By forming the rear wall 108 integral with the sides 110 as illustrated, the rear wall 108 may flex outward when a force perpendicular to the rear wall 108 is exerted on rear wall 108. Additionally, by forming rear wall 108 integral with the sides 110, the upper shell 102 is strengthened and more robust, thus unlikely to deform when force is applied to the top wall 114 of the SFP cage 100 when mounting the SFP cage 100 on the circuit board.

Figure 2:
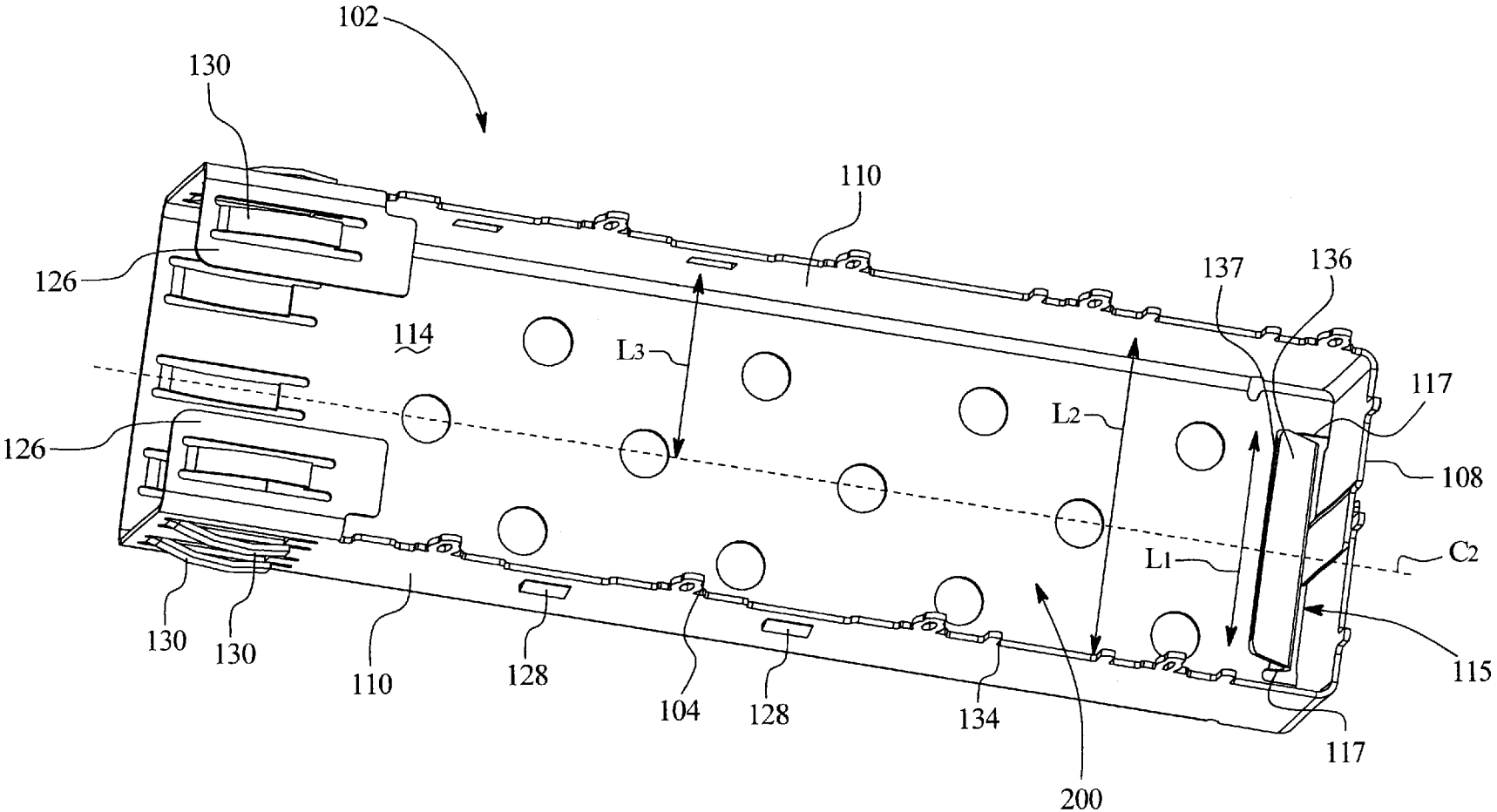
FIG. 2 illustrates a bottom view of the upper shell formed in accordance with an embodiment of the present invention.

FIG. 2 illustrates a bottom view of the upper shell 102. The rear end 115 of the top wall 114 is bent down at an acute angle into the module retention chamber 200 of the upper shell 102 to form kickout spring 136. Kickout spring 136 has a spring width $L_1$ extending between the inner notches 117 which is slightly less than the shell width $L_2$ between the side walls 110. The kickout spring 136 includes a lead edge 137 positioned within the module retention chamber 200 remote from the rear wall 108. $C_2$ illustrates the center line of the upper shell relative to the side walls 110. $L_3$ illustrates the distance from the center line $C_2$ to the side wall 110. $L_3$ is substantially equidistant from the center line $C_2$ to each of the side walls 110 along the length of the upper shell 102. Although the kickout spring 136 is illustrated as integral with the top wall 114 of the upper shell 102, it should be understood that the kickout spring 136 may also be utilized with other SFP cages, such as a one piece SFP cage.

Figure 3:
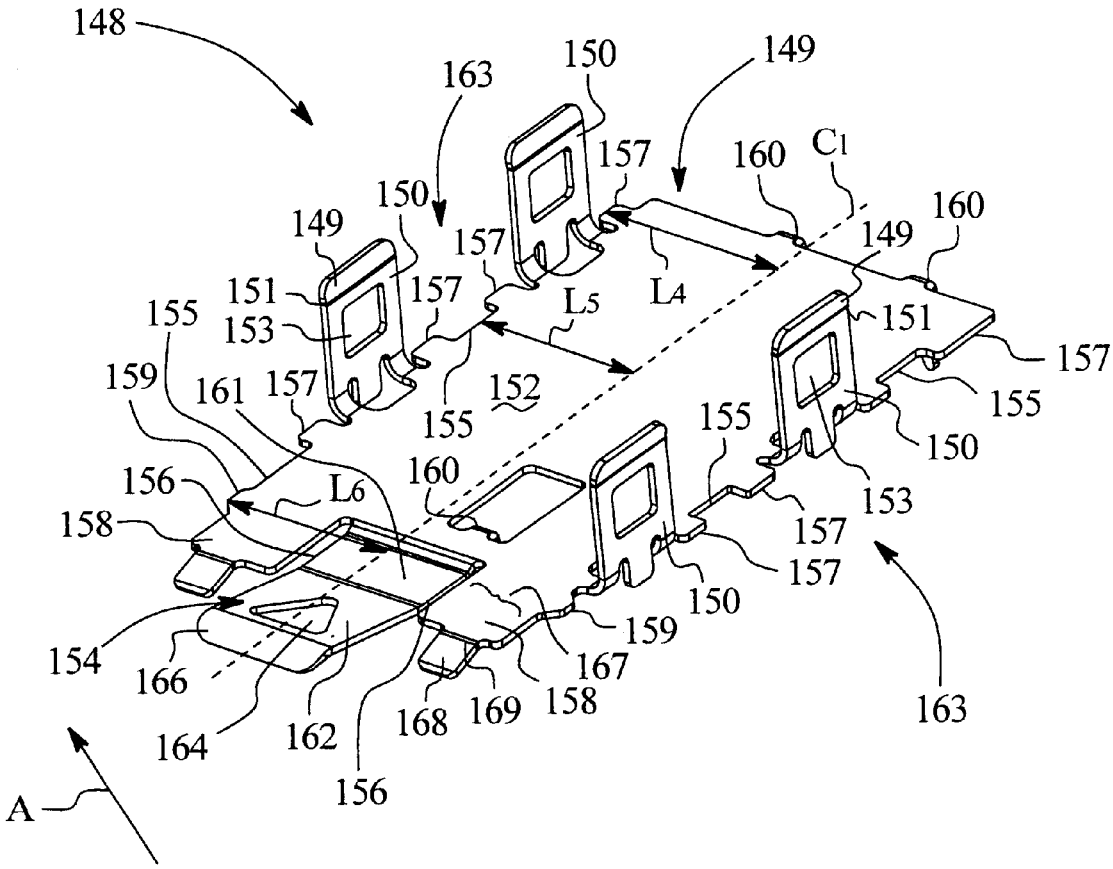
FIG. 3 illustrates a lower shell of an SFP cage formed in accordance with an embodiment of the present invention.

FIG. 3 illustrates a lower shell 148 of the SFP cage 100. The lower shell 148 is bent and formed from one piece of sheet material. Snap over tabs 150 are bent to extend perpendicular to a bottom wall 152. The snap over tabs 150 include an opening 153 and a leading edge 149 at the top end. The leading edge 149 is bent slightly outward at intersection 151. A spring latch 154 and interlocking members 158 protrude from the front edge of the bottom wall 152 to snappably engage a module inserted into the cage 100. The interlocking members 158 comprise a base section 167 and a tip portion 168. The tip portion 168 protrudes from the front end of the base section 167 at the intersection 169 and is narrower in width than the base section 167. The tip portion 168 is bent downward at the intersection 169.

Grooves 156 are cut in the front edge of the bottom wall 152 to separate the spring latch 154 from the interlocking members 158 which are located on either side of the spring latch 154. The spring latch 154 is bent downward and back to form a plateau 161. The plateau 161 occupies a plane parallel to and slightly below the plane of the bottom wall 152 relative to the module retention chamber 200 formed when the upper and lower shells 102 and 148 are joined. Forward of the plateau 161, the spring latch 154 is bent up in the direction of arrow A to form an intermediate portion 162 with a triangular shaped cutout 164. Forward of the triangular shaped cutout 164, the spring latch 154 is bent downward at an obtuse angle to the intermediate portion 162 to form a guiding lip 166.

Notches 155 are cut from the outer edges 163 of the bottom wall 152 towards the center line $C_1$ of lower shell 148. The locations of the notches 155 coincide with the placement of the press fit pins 104 on the upper shell 102. Protrusions 157 extend from the outer edges 163 at other positions, away from the center line $C_1$. The distance $L_4$ from the center line $C_1$ of the lower shell 148 to the protrusions 157 is greater than the distance $L_3$, which is the distance between the side walls 110 and center line $C_2$ of the upper shell 102 (FIG. 2). Therefore, the protrusions 157 may contact and/or extend beyond the bottom edge of side walls 110. In contrast, the distance $L_5$ from the center line $C_1$ of the lower shell 148 to the notches 155 is less than or equal to the distance $L_3$. Thus, the notches 155 may contact the side walls 110 or the press fit pins 104. Protrusions 159 proximate the front of bottom wall 152 are a distance $L_6$ from the center line $C_1$. The distance $L_6$ is less than or equal to $L_3$, allowing the bottom wall 152 at protrusions 159 to fit between the side walls 110. Protrusions 159 may contact the side walls 110.

Figure 7:
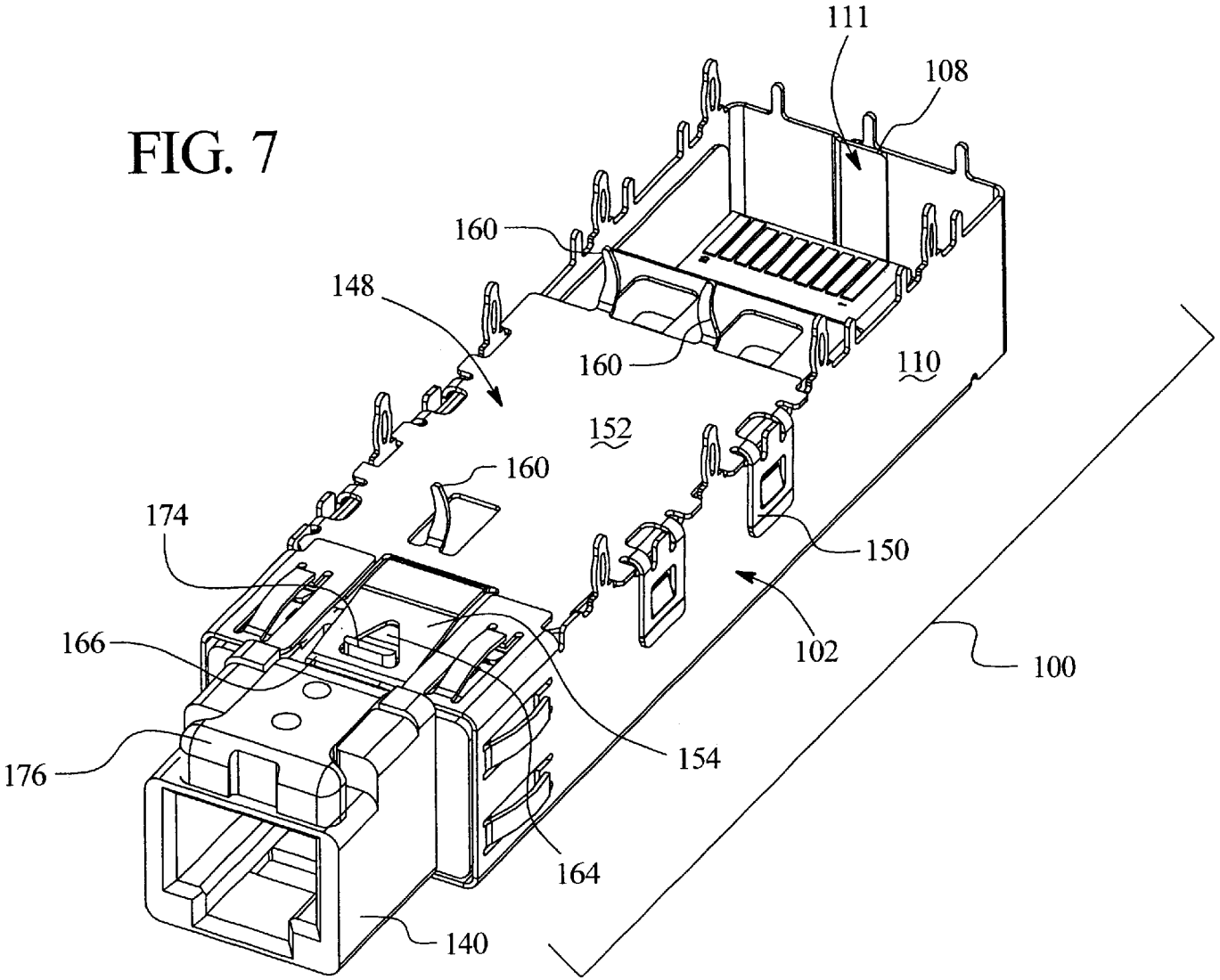
FIG. 7 illustrates a bottom view of a module inserted into an assembled SFP cage formed in accordance with an embodiment of the present invention.

Two crescent shaped grounding beams 160 protrude from the rear end 149 of the bottom wall 152. A third crescent shaped grounding beam 160 is bent and formed in the central region of the bottom wall 152 behind the spring latch 154. The crescent shaped grounding beams 160 are also illustrated in FIG. 7, which includes a bottom view of the lower shell 148. The grounding beams 160 are integral with the bottom wall 152, and are bent downward and occupy a plane perpendicular to the plane of the bottom wall 152. The grounding beams 160 protruding from the rear end 149 are oriented such that the grounding beams 160 curve away from each other. The grounding beams 160 are inserted into holes in the circuit board to form a grounding connection therewith. The grounding beams 160 may be inserted into the circuit board with less force than the force used to insert press fit pins 104 on upper shell 102. Thus, the lower shell 148 does not deflect when the SFP cage 100 is press fit onto the circuit board.

Figure 4:
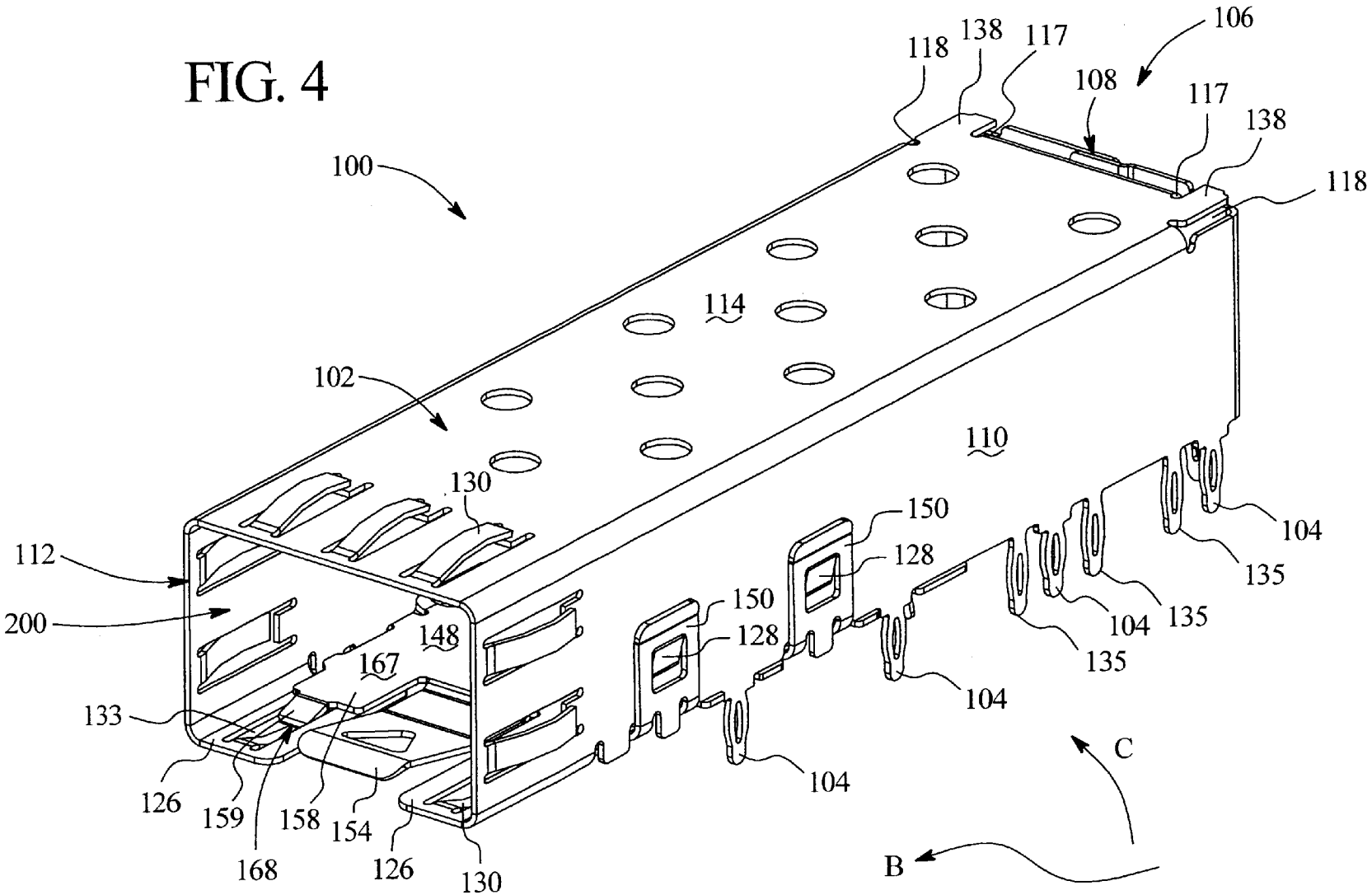
FIG. 4 illustrates an assembled SFP cage formed in accordance with an embodiment of the present invention.

FIG. 4 illustrates an assembled SFP cage 100. The upper shell 102 and lower shell 148 are mated together to form the module retention chamber 200 which is accessible through the open front end 112. As discussed previously, the EMI pins 135 may be press fit pins. Alternatively, the press fit pins 104 and EMI pins 135 may be formed as solder legs, and thus may be soldered to the circuit board.

During assembly, the spring latch 154 on the lower shell 148 is inserted along the path of arrow B into the interior of the upper shell 102 at an acute angle relative to the base portions 126 such that the interlocking members 158 are positioned above the base portions 126, and the spring latch 154 is located between the base portions 126. The press fit pins 104 on the upper shell 102 are positioned interleaved with the snap over tabs 150 on the lower shell 148. The lower shell 148 is then rotated along the path of arrow C in order that the snap over tabs 150 slide along the outside of the upper shell 102 until the snap over tabs 150 engage the latching features 128 on the side walls 110. Therefore, the SFP cage 100 may be assembled without soldering, welding, or other fastening mechanism or process.

The base sections 167 of the interlocking members 158 engage the rear portions 127 of the base portions 126 (FIG. 1) with a downward force. The base sections 167 extend to at least the forward edge of the tab 129 (FIG. 1) on the base portions 126. The tip portion 168 of the interlocking members 158 extends over the tab 129 of the base portions 126 and extends downward into the window 133 formed when the grounding members 130 are stamped. Therefore, when the SFP cage 100 is mounted in a chassis or bezel, and the ground members 130 are engaging the chassis, the downward force of the interlocking members 158 of the lower shell 148 on the base portions 126 of the upper shell 102 prevents the base portions 126 from deflecting upward into the module retention chamber 200, and the tip portion 168 engages the inner edges of the window 133, preventing the side walls 110 from being deformed inward.

Figure 8:
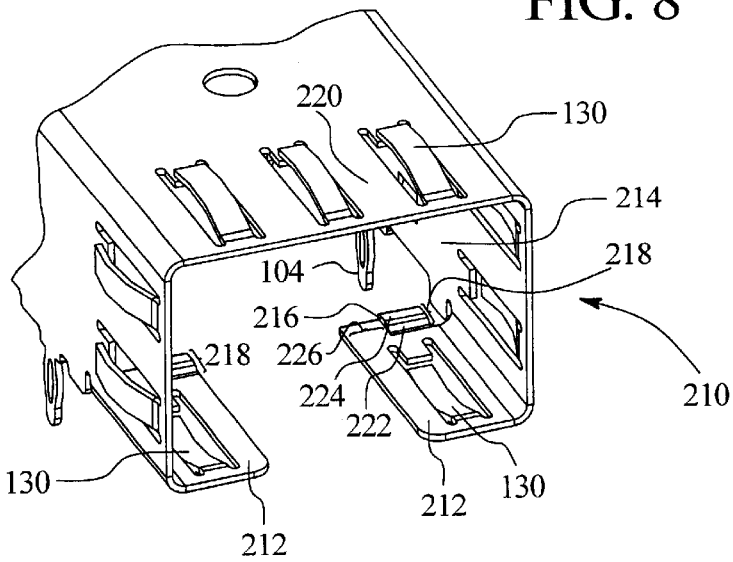
FIG. 8 illustrates the interlocking features of an upper shell of an SFP cage formed in accordance with an embodiment of the present invention.
Figure 9:
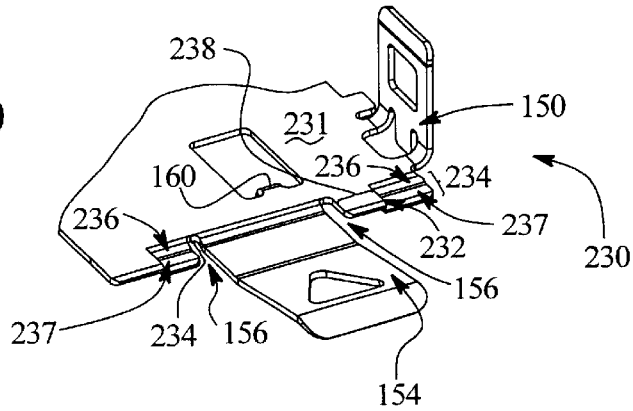
FIG. 9 illustrates the interlocking features of a lower shell of an SFP cage formed in accordance with an embodiment of the present invention.
Figure 10:
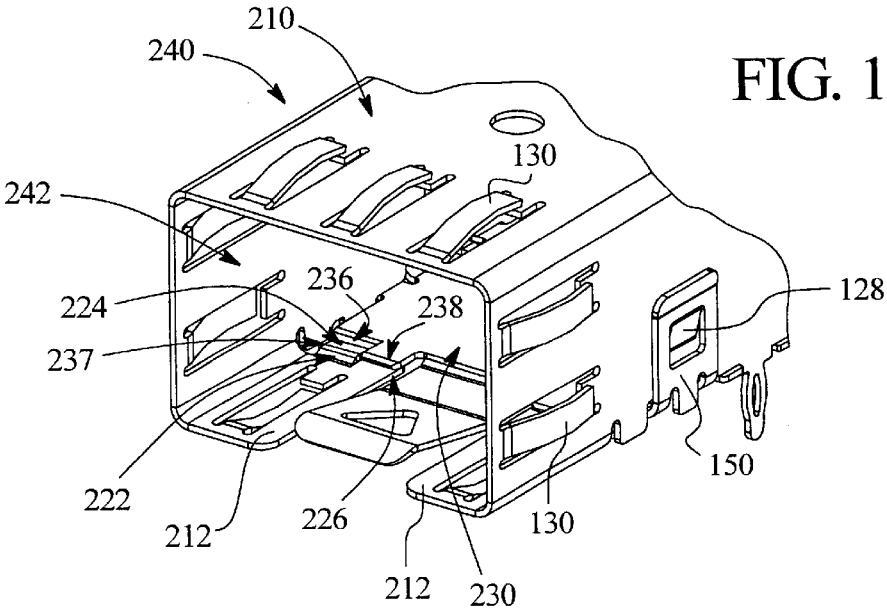
FIG. 10 illustrates an assembled SFP cage utilizing the interlocking features of FIGS. 8 and 9 formed in accordance with an embodiment of the present invention.

FIG. 8 illustrates an alternative embodiment of the interlocking features of upper shell 210. Features previously discussed are illustrated in FIGS. 8–10 using the aforementioned item numbers. Upper shell 210 includes base portions 212 formed integral with side walls 214. Base portions 212 include a notch or shear 216 cut in the back end of base portions 212. An upper tab 218 is bent and formed integral with base portions 212 and adjacent to the shear 216. Upper tab 218 is bent toward top wall 220 to form a ramped surface 222. Upper tab 218 is then bent away from top wall 220 to form a plateau 224 substantially parallel to base portions 212. Back end 226 is adjacent to the shear 216 and occupies the same plane as the base portions 212.

FIG. 9 illustrates an alternative embodiment of the interlocking features of lower shell 230. The bottom wall 231 includes a notch or shear 232 cut in the front edge. Lower tab 234 is integral with bottom wall 231 and is bent and formed adjacent to the shear 232. Lower tab 234 is bent downward to form ramped surface 236, then bent upwards to form a plateau 237 substantially parallel to bottom wall 231. Front portion 238 is adjacent to the shear 232 and occupies the same plane as bottom wall 231.

FIG. 10 illustrates an assembled SFP cage 240 utilizing the interlocking features of upper shell 210 and lower shell 230. Upper shell 210 and lower shell 230 are mated together in a manner similar to SFP cage 100 of FIG. 4, forming a front opening 242. However, the plateau 224 of upper tab 218 extends over, touches and may press upon the plateau 237 of lower tab 234, and front portion 238 extends partially over, touches and may press upon a portion of the back end 226. Therefore, upper and lower tabs 218 and 234, combined with front portion 238 and back end 226, prevent the front opening 242 from being deformed from side, top, and/or bottom forces when the SFP cage 240 is mounted in a chassis or bezel. As illustrated in FIGS. 8 and 9, the interlocking features may be symmetrical, wherein upper and lower tabs 218 and 234 are formed on each side of the upper and lower shells 210 and 230 in the same orientation from left to right. Alternatively, as illustrated in FIG. 10, the interlocking features may be asymmetrical, wherein upper and lower tabs 218 and 234 are both formed closer to the side walls 214, or closer to the center of SFP cage 240.

Figure 5:
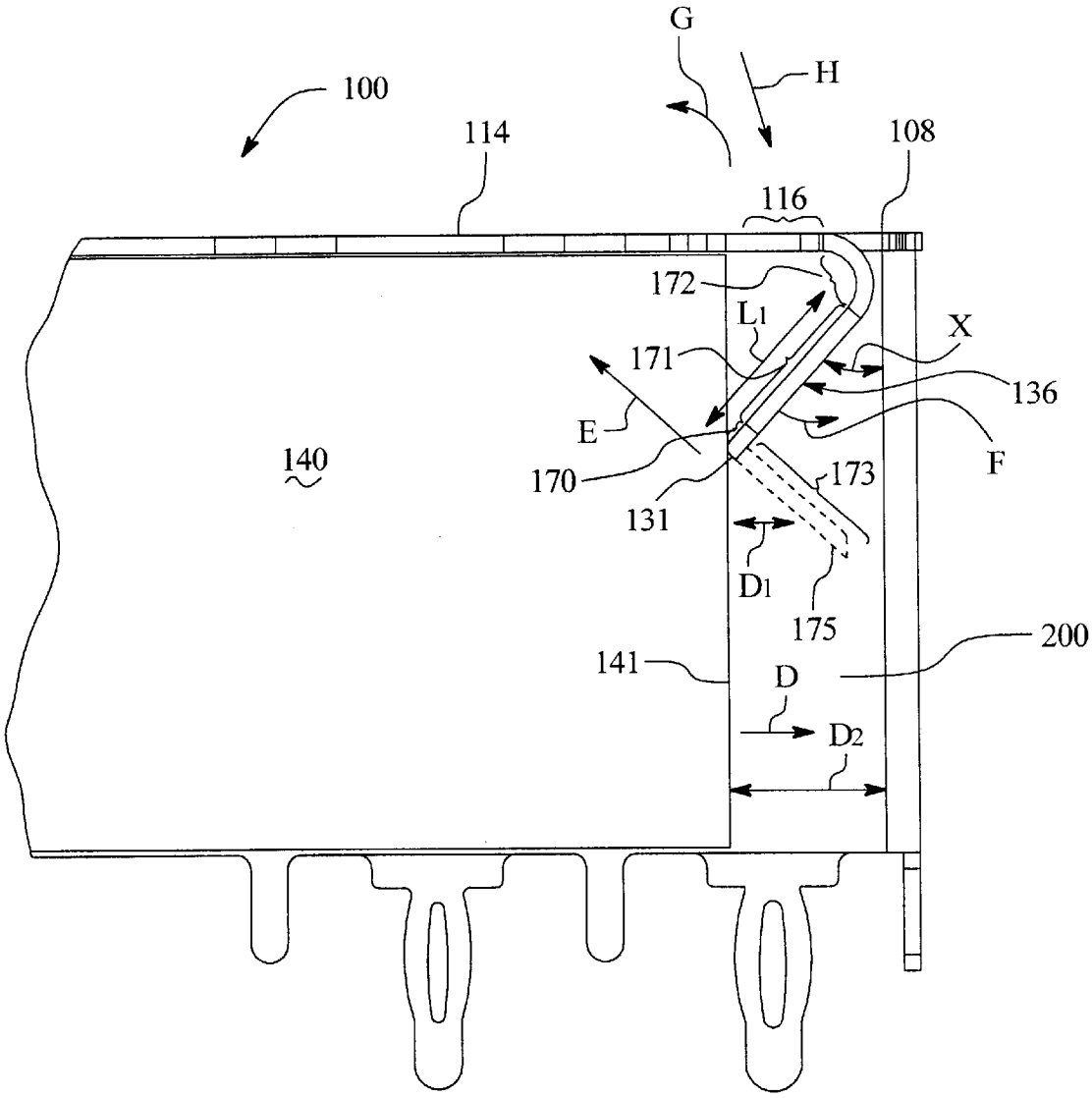
FIG. 5 illustrates a side view of the kickout spring and a portion of the SFP cage with an SFP module inserted formed in accordance with an embodiment of the present invention.

FIG. 5 illustrates a side view of the kickout spring 136 and a portion of the SFP cage 100 with an SFP module 140 inserted. The kickout spring 136 comprises a module engaging portion 170 integral with a lever portion 171 that projects downward and into the module retention chamber 200 to engage a plug or SFP module 140 at lead edge 131. The kickout spring 136 also includes a radiused portion 172. The radiused portion 172 is integral with the flexible section 116 proximate the back end of the top wall 114, and may not engage rear wall 108 when kickout spring 136 is at rest. When no force is applied to the kickout spring 136, the lever portion 171 rests at an acute angle X relative to the rear wall 108. Also, kickout spring 136 occupies a space proximate the rear wall 108 with the lead edge 131 located a distance $D_2$ from the rear wall 108, such that a module 140 cannot be locked into the SFP cage 100 without deflecting the kickout spring 136. Alternatively, kickout spring 136 may extend beyond lead edge 131. Kickout spring 136 may be bent downward and toward rear wall 108 to form rear wall engaging portion 173. The outer end 175 of the rear wall engaging portion 173 may be rounded slightly.

Figure 6:
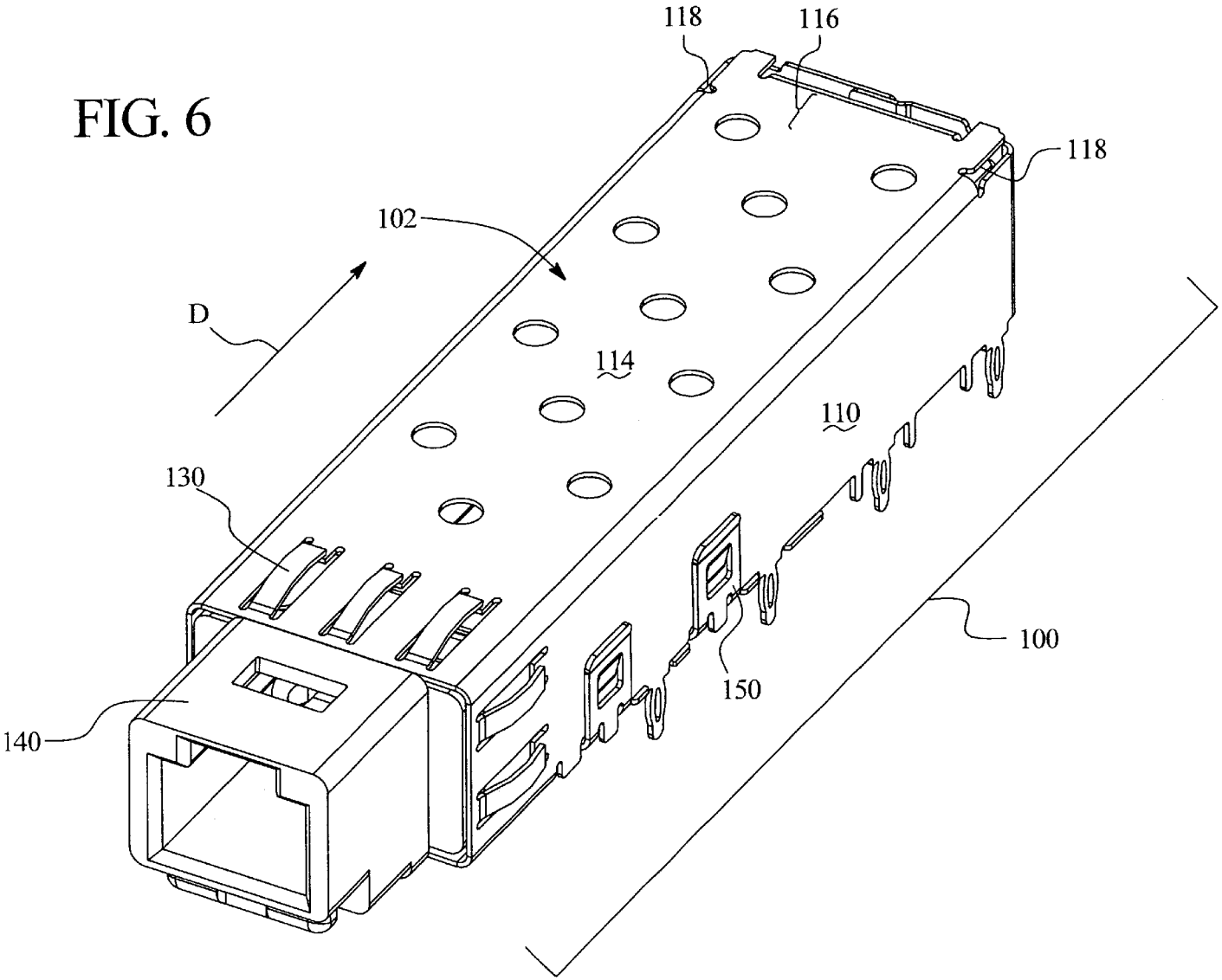
FIG. 6 illustrates a top view of a module inserted into an assembled SFP cage formed in accordance with an embodiment of the present invention.

FIGS. 6 and 7 illustrate top and bottom views, respectively, of a module 140 inserted into an assembled SFP cage 100. FIGS. 5–7 will be discussed together. 1391 When the module 140 is inserted into the module retention chamber 200 in the direction of arrow D, the back wall 141 of the module 140 engages the lead edge 131 of the module engaging portion 170 of the kickout spring 136. As the insertion force from the module 140 in the direction of arrow D overcomes the spring force in the direction of arrow E created by the kickout spring 136, the kickout spring 136 deflects in the arcuate direction of arrow F towards the rear and top walls 108 and 114. For example, the module engaging portion 170 may be deflected a distance $D_1$ as measured from the position of the lead edge 131 when in its resting position. As the kickout spring 136 deflects, the radiused portion 172 flexes up and back, and may contact and deflect the rear wall 108 outward. As a result, the angle X becomes smaller. Also, the flexible section 116 of the top wall 114 between outer notches 118 bends upward and away from the plane of the top wall 114 in the direction of arrow G. The resiliency and memory of the flexible section 116 is enhanced by the length $L_1$ of the kickout spring 136. Optionally, if kickout spring 136 includes the rear wall engaging portion 173, the outer end 175 may contact and deflect rear wall 108 outward with a force in the direction of arrow D.

The module 140 is pushed in the direction of arrow D until the module latch 174 (FIG. 7) slides under the guiding lip 166 on the spring latch 154 and engages the cutout 164. When securely latched, the release button 176 of the module 140 is fully extended towards the front end of the module 140 and fits under the guiding lip 166 of the spring latch 154. The module latch 174 and cutout 164 securely hold the module 140 and SFP cage 100 mated together while the module engaging portion 170 exerts a potential force on the back wall 141 of the module 140. It should be understood that other latching mechanisms may be used to secure the module 140 inside SFP cage 100.

To unlatch the module 140 from the SFP cage 100, the release button 176 is pressed towards the rear wall 108 of SFP cage 100, in the direction of arrow D. The release button 176 slides under the spring latch 154 and deflects the spring latch 154 out and away from bottom wall 152 until the module latch 174 is no longer engaged by the cutout 164. The flexible section 116 exerts a force in direction H, the rear wall 108, module engaging portion 170 and lever portion 171 exert force in the direction E. The directions E and H and the force exerted may vary depending upon the length of the kickout spring 136, the angle X, the sheet material used to construct the upper shell 102, and the like. The module 140 is ejected at least the distance D1 out of the SFP cage 100 by the forces, and the kickout spring 136 returns to its original location at angle X relative to the rear wall 108.

The force of the kickout spring 136 combined with the forces from the flexible section 116 and rear wall 108 provides sufficient, reliable force to eject the module 140. Furthermore, the kickout spring 136 is larger than previous kickout springs as discussed previously, and thus is better able to retain its memory and resiliency when modules 140 are inserted and ejected multiple times.

The SFP cage 100 provides improved strength and rigidity. The ground members 130 are located on the upper shell 102 which defines the open front end 112. The interlocking features of the upper and lower shells 102 and 148, such the base portions 126, base sections 167 and tip portions 168 (FIGS. 1–4), and upper and lower tabs 218 and 234, front portions 238 and back ends 226 (FIGS. 8–10), prevent the open front end 112 from being deformed when mounting the SFP cage 100 on a circuit board and/or in a chassis or bezel. By locating the press fit pins 104 and EMI pins 134, 135 integral with and parallel to the side walls 110 of the upper shell 102 rather than on the lower shell 148 of the SFP cage 100 or on a single piece SFP cage, the side walls 110 are not deformed when the SFP cage 100 is press fit on a circuit board. Furthermore, by forming the closed back end 106 integral with and perpendicular to the side walls 110, increased rigidity of the upper shell 102 is achieved.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A small form factor pluggable (SFP) cage, comprising:

upper and lower shells joined to one another to define a module retention chamber, at least one of said upper and lower shells having pins extending therefrom that are configured to be joined with a circuit board, said module retention chamber having an open front end configured to accept a module and having a closed back end, at least one of said upper and lower shells having a rear wall closing said back end, at least one of said upper and lower shells having side walls extending between said front and back ends, said upper shell having a top wall extending between said front and back ends, said top wall having a flexible section formed therein proximate said back end; and a kickout spring joined to said flexible section of said top wall, said kickout spring having a module engaging section extending into said module retention chamber toward said front end, said module engaging section being configured to contact and exert an ejection force on a module when inserted into said module retention chamber.

2. The SFP cage of claim 1, wherein said module engaging section of said kickout spring includes a planar lever projecting downward into said module retention chamber, said lever being biased to rest normally at an acute angle to said top wall.

3. The SFP cage of claim 1, wherein said kickout spring includes an intermediate radiused portion that is flexible to permit arcuate motion of said module engaging section downward toward said lower shell and rearward toward said rear wall when a module is loaded into said module retention chamber.

4. The SFP cage of claim 1, wherein said flexible section is deflectable upward away from a plane containing said top wall and wherein said kickout spring is deflectable rearward toward said back end.

5. The SFP cage of claim 1, wherein said flexible section exerts a first biasing force and said kickout spring exerts a second biasing force, said first and second biasing forces being configured to collectively induce an ejection force upon a module loaded in said module retention chamber.

6. The SFP cage of claim 1, wherein said flexible section of said top wall is deflected upward when a module is loaded into said module retention chamber.

7. The SFP cage of claim 1, wherein said top and side walls are formed integral with one another along opposed edges extending between said front and back ends, said flexible section of said top wall being separated from said side walls by notches cut along portions of said opposed edges.

8. The SFP cage of claim 1, wherein said top and side walls are formed integral with one another along opposed edges extending along an entire length of said upper shell from said front end to said back end, said top wall having notches cut in a rear edge thereof, said notches extending parallel to one another and being spaced inward from said opposed edges, said notches defining said flexible section therebetween.

9. The SFP cage of claim 1, wherein said kickout spring includes an intermediate radiused portion configured to exert a force on said rear wall when a module is loaded into said module retention chamber.

10. The SFP cage of claim 1, wherein said flexible section of said top wall is separated from said side and rear walls by notches between said top, rear and side walls proximate said back end.

11. The SFP cage of claim 1, wherein said kickout spring includes a deflectable base portion joined to said flexible section of said top wall, an intermediate knee portion configured to contact a module when loaded, and a free standing outer end configured to contact and deflect outward said rear wall to afford a dual action spring force.

12. The SFP cage of claim 1, wherein said kickout spring flexes along an arcuate path aligned in a plane extending parallel to a length of said upper shell.

13. The SFP cage of claim 1, wherein said flexible section bends about a rotation axis extending in a direction transverse to a length of said top wall.

14. The SFP cage of claim 1, wherein said kickout spring includes a flex portion that bends about an axis of rotation extending in a direction transverse to a length of said upper shell, said axis of rotation being located proximate to, and extending in a direction parallel with, a horizontal plane defined by said top wall.

15. The SFP cage of claim 1, wherein said kickout spring includes an intermediate radiused portion configured to contact said rear wall when a module is loaded into said module retention chamber, said flexible section, kickout spring, and rear wall exerting first, second, and third biasing forces, respectively, said first, second, and third biasing forces collectively exerting an ejection force upon the module.

16. The SFP cage of claim 1, said flexible section of said top wall being physically separated from said side and rear walls.

17. An electrical connector receptacle cage, comprising:

upper and lower shells joined to one another to form a plug retention chamber, said plug retention chamber having an open front end configured to accept an electrical plug and having a closed back end, at least one of said upper and lower shells having a rear wall closing said back end, at least one of said upper and lower shells having side walls extending between said front and back ends, said upper shell having a top wall extending between said front and back ends, said top wall having a flexible section formed therein proximate said back end, said flexible section of said top wall being physically separated from said side and rear walls; and a kickout spring joined to said flexible section of said top wall, said kickout spring having a plug engaging section extending into said plug retention chamber toward said front end, said plug engaging section being configured to contact a plug and exert an ejection force onto the plug when the plug is inserted into said plug retention chamber.

18. The electrical connector receptacle cage of claim 17, wherein said plug engaging section of said kickout spring includes a planar lever projecting downward into said plug retention chamber, said lever being biased to rest normally at an acute angle to said top wall.

19. The electrical connector receptacle cage of claim 17, wherein said kickout spring includes an intermediate radiused portion that is flexible to permit arcuate motion of said plug engaging section downward toward said lower shell and rearward toward said rear wall when a plug is loaded into said plug retention chamber.

20. The electrical connector receptacle cage of claim 17, wherein said flexible section is deflectable upward away from a plane containing said top wall and wherein said kickout spring is deflectable rearward toward said back end.

21. The electrical connector receptacle cage of claim 17, wherein said flexible section is configured to exert a first biasing force and said kickout spring is configured to exert a second biasing force onto a plug loaded in said plug retention chamber.

22. The electrical connector receptacle cage of claim 17, wherein said flexible section of said top wall is deflected upward when a plug is loaded into said plug retention chamber.

23. The electrical connector receptacle cage of claim 17, wherein said top and side walls are integral with one another along opposed edges extending between said front and back ends, said flexible section of said top wall being separated from said side walls by notches cut along portions of said opposed edges.

24. The electrical connector receptacle cage of claim 17, wherein said flexible section of said top wall is separated from said side walls by notches between said top and side walls proximate said back end.

25. The electrical connector receptacle cage of claim 17, wherein said kickout spring is deflectable toward said rear wall, a portion of said kickout spring being configured to deflect said rear wall outward when a plug is loaded into said plug retention chamber.

26. The electrical connector receptacle cage of claim 17, wherein said kickout spring is configured to contact said rear wall when a plug is loaded into said plug retention chamber, said rear wall exerting a bias force on said kickout spring to eject said plug.

* * * * *